US006820350B1

(12) United States Patent
Eriksson et al.

(10) Patent No.: US 6,820,350 B1
(45) Date of Patent: Nov. 23, 2004

(54) METHOD OF DRYING LIGNOCELLULOSE MATERIAL

(75) Inventors: Lennart V. Eriksson, Växjö (SE); Stig Lennartsson, Växjö (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 10/148,733

(22) PCT Filed: Nov. 16, 2000

(86) PCT No.: PCT/SE00/02251

§ 371 (c)(1),
(2), (4) Date: May 31, 2002

(87) PCT Pub. No.: WO01/39945

PCT Pub. Date: Jun. 7, 2001

(30) Foreign Application Priority Data

Dec. 3, 1999 (SE) ..... 9904450

(51) Int. Cl.[7] ..... F26B 5/08
(52) U.S. Cl. ..... 34/316; 34/371; 34/592
(58) Field of Search ..... 34/316, 359, 360, 34/362, 371, 476, 477, 591, 592, 79, 219, 427, 318, 396

(56) References Cited

U.S. PATENT DOCUMENTS 2,014,764 A * 9/1935 Gram ..... 34/24
2,023,247 A * 12/1935 Senseman ..... 83/11
2,235,683 A * 3/1941 Horesi ..... 34/24
2,274,789 A * 3/1942 Horesi ..... 127/38
2,770,543 A * 11/1956 Arnold et al. ..... 426/518
3,707,775 A * 1/1973 Kaltin ..... 34/10
3,998,583 A * 12/1976 Hinterkeuser et al. ..... 432/14

FOREIGN PATENT DOCUMENTS

EP 0 876 887 A2 11/1998
SE WO 92/08938 * 5/1992 ..... F26B/3/10

* cited by examiner

*Primary Examiner*—Kenneth Rinehart
(74) *Attorney, Agent, or Firm*—Lerner, David, Littenberg, Krumholz & Mentlik, LLP

(57) ABSTRACT

Methods for drying fibrous lignocellulosic material are provided in connection with the manufacture of fiberboard. The fibrous material is transported with a first drying gas through a first drying line to a first cyclone where the first drying gas in conducted away from the fibrous material. Thereafter, the material is transported with a second drying gas through a second drying line to a second cyclone, where the second drying gas is conducted away while the fibrous material is advanced to a subsequent step. The second drying gas, which is conducted away from the second cyclone, is recirculated to the first drying step and used as a portion of the first drying gas. A portion of the first drying gas, which is conducted away from the first cyclone, is recirculated and used as drying gas at the first drying step.

4 Claims, 1 Drawing Sheet

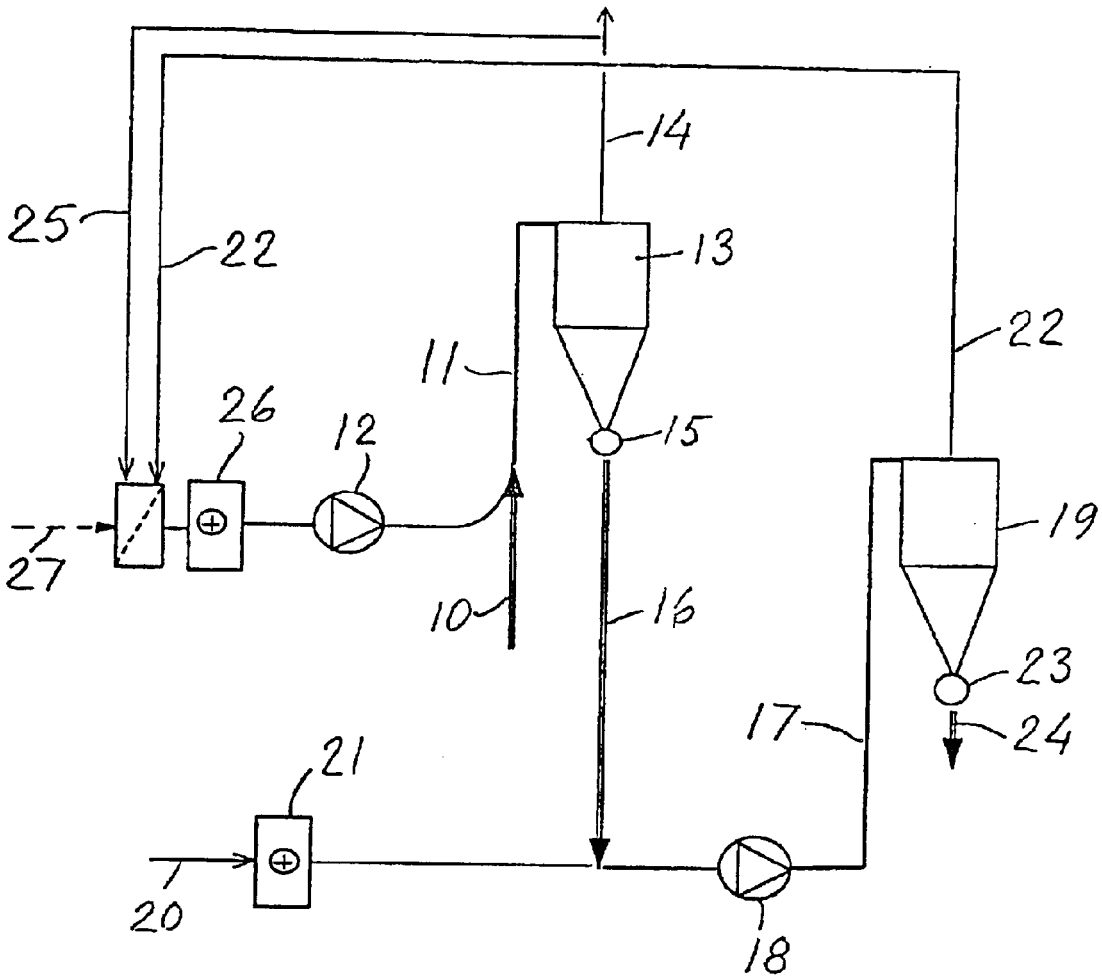
14
25
22
13
22
11
26
12
15
19
27
10
16
23
17
24
21
20
18

METHOD OF DRYING LIGNOCELLULOSE MATERIAL

FIELD OF THE INVENTION

The present invention relates to a method of drying lignocellulosic fibrous material in connection with the manufacture of fiberboard, for example MDF (Medium Density Fiberboard). This fibrous material generally consists of mechanically defibered size-coated fibers. For achieving optimum drying results, the drying is carried out in two steps, and with the help of drying gas. In the first step the fibrous material is transported with a first drying gas through a first drying line to a first cyclone, where the drying gas is separated from the material. Thereafter, the material is transported with a second drying gas through a second drying line to a second cyclone, where the drying gas is separated from the material. From the second drying step the material is moved to subsequent steps in the process for the manufacture of fiberboard. During two-step drying in this manner, both steps can be carried out with drying gas, which consists of air, which is heated with flue gas either directly or indirectly, or in some other way.

In dryers of this type great environmental problems arise due to the emission of fiber dust, formaldehyde and volatile organic compounds (VOC). One way to reduce these problems is to recycle the separated second drying gas from the second cyclone to the first step. In order to bring about additional cleaning of the gas emitted from the dryer, however, it is necessary to use separate cleaning equipment, for example gas scrubbers, RTO (Regenerative Thermal Oxidizer) or WESP (Wet Electrostatic Precipitator). This implies, however, that the cost of the drying plant increases considerably.

SUMMARY OF THE INVENTION

In accordance with the present invention, these and other problems have been overcome by the invention of a method for drying fibrous lignocellulosic material in connection with the manufacture of fiberboard comprising transporting the fibrous lignocellulosic material by means of a first drying gas to a first cyclone, separating the first drying gas from the fibrous lignocellulosic material in the first cyclone, transporting the fibrous lignocellulosic material separated from the first drying gas by means of second drying gas to a second cyclone, separating the second drying gas from the fibrous lignocellulosic material in the second cyclone, recirculating the separated second drying gas for use as a first portion of the first drying gas, and recirculating the separated first drying gas for use as a second portion of the first drying gas. In a preferred embodiment, the method includes controlling the flow of the recirculating first drying gas so as to avoid condensation in this method.

In accordance with one embodiment of the method of the present invention, fresh air is utilized as a portion of the second drying gas, the fresh air comprising the entire amount of fresh air used in this method.

In accordance with another embodiment of the method of the present invention, the method includes recirculating from 50% to 60% of the separated first drying gas for use as the second portion of the first drying gas.

BRIEF DESCRIPTION OF THE DRAWING

The present invention may be more fully appreciated with reference to the following detailed description, which, in turn, refers to the drawing which is a top, elevational, schematic view of a plant employing the method of the present invention.

DETAILED DESCRIPTION

In a plant such as that shown in the Figure the fibrous material is supplied through a line 10 in a first drying line 11. With the help of a first fan 12 a first drying gas is blown into the drying line 11 and transports the fibrous material with simultaneous drying to a first cyclone 13. In cyclone 13 the drying gas is separated through an outlet 14, while the lignocellulosic material is advanced to a second drying line 17 by means of sluice means 15 and line 16. With the help of a second drying gas and a second fan 18 the material is transported with additional simultaneous drying to a second cyclone 19. The second drying gas contains fresh air, which is supplied through a line 20 and heated, directly or indirectly, in heating means 21. The heating can be effected by flue gas, gas from a gas burner, or in some other way by direct supply or heat exchange. In the second cyclone 19 the drying gas is separated through a discharge line 22, and the fibrous material is taken out by means of sluice means 23 and line 24 to be transported further to a subsequent step in the process for fiberboard manufacture.

The separated second drying gas moves through discharge line 22 to the first drying step, where it is introduced into the first drying line 11 and thereby constitutes a part of the first drying gas.

An additional closure of the drying system is obtained by means of a portion of the drying gas separated from the first cyclone 13 through the outlet 14 recycled through a line 25 to the first drying step where it is introduced into the first drying line 11. The first drying gas thus contains a mixture of the drying gas separated from the second drying step and a portion of the drying gas separated from the first drying step. In a heating means 26 the first drying gas is heated, either directly or indirectly. The heat source used there can be flue gas, gas from a gas burner, or some other source, and the heating is either carried out directly or in a heat exchanger. Fresh air can also be introduced into the first drying step through a line 27.

In the drying plant described above the temperature of the first drying gas at the inlet to the first step should be from about 130° to 200° C., and at the outlet from the first cyclone from about 45° to 90° C. Corresponding inlet and outlet temperatures of the second drying gas should be from about 80° to 150° C. and, respectively, from about 30° to 80° C., respectfully. With an ingoing moisture content of the fibrous material of from about 50% to 150% the outgoing moisture content can be reduced to from about 3% to 15%.

By recycling the drying gas from the second drying step to the first drying step the heat content in this drying gas can be recovered in the system. The separated second drying gas is also relatively dry and thus does not cause condensation problems in the system. This recycling of drying gas results in the total emission of gas being reduced, and at the same time the heat economy being potentially improved.

Moreover, by recycling a portion of the separated first drying gas to the first drying step, the heat economy can be improved still more. This recycling further results in the wet air flow out of the dryer being reduced substantially. With the return only of the second drying gas flow the total wet air flow out of the dryer can be reduced by about 20% to 25%. If in addition the first drying gas flow is partially recycled, the total wet air flow out of the dryer can be reduced to about 40% to 50% of the wet air flow without drying gas recycling, i.e. about 50% to 60% is recycled. The reduced wet air flow out of the dryer results in the costs for the separate cleaning equipment, which can be necessary to install, being considerably lower.

The method according to the present invention also results in the entire required fresh air amount being supplied to the drying system in the second drying step through line 20. The re-circulated flow of the first drying gas is controlled so that condensation does not occur in the system. The size of the portion of the first drying gas flow which is recycled thus depends on other parameters, such as ingoing fiber moisture, gas temperature, etc.

Compared with conventional plants, the method according to the present invention permits the outgoing fiber moisture to be controlled very effectively, while the energy consumption can be reduced, the capacity of the plant can be increased, emissions detrimental to the environment can be reduced, and the costs for separate cleaning equipment can be decreased.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method for drying fibrous lignocellulosic material in connection with the manufacture of fiberboard comprising transporting said fibrous lignocellulosic material by means of a first drying gas to a first cyclone, separating said first drying gas from said fibrous lignocellulosic material in said first cyclone, transporting said fibrous lignocellulosic material separated from said first drying gas by means of second drying gas to a second cyclone, separating said second drying gas from said fibrous lignocellulosic material in said second cyclone, recirculating the entire amount of said separated second drying gas for use as a first portion of said first drying gas, and recirculating a major portion of said separated first drying gas for use as a second portion of said first drying gas.

2. The method for drying fibrous lignocellulosic material according to claim 1, wherein said major portion of said separated first drying gas includes 50% to 60% of said separated first drying gas.

3. The method for drying fibrous lignocellulosic material in connection with the manufacture of fiberboard according to claim 1, including controlling the flow of said major portion of said separated first drying gas, so as to avoid condensation in said method.

4. The method for drying fibrous lignocellulosic material in connection with the manufacture of fiberboard according to claim 1, wherein fresh air is utilized as a portion of said second drying gas, said fresh air comprising the entire amount of fresh air used in said method.

* * * * *